US005466314A

United States Patent [19]

Rauber et al.

[11] Patent Number: 5,466,314

[45] Date of Patent: Nov. 14, 1995

[54] SMOKE CHARGE AND METHOD FOR ITS PREPARATION

[75] Inventors: Walter Rauber, Gwatt; Markus Tobler, Seftigen, both of Switzerland

[73] Assignee: Schweizerische Eidgenossenschaft Vertreten Durch Die Eidg. Munitionsfabrik Thun der Grupper fur Rustungsdienste, Thun, Switzerland

[21] Appl. No.: 311,164

[22] Filed: Sep. 23, 1994

[30] Foreign Application Priority Data

Oct. 1, 1993 [CH] Switzerland ..... 02959/93

[51] Int. Cl.[6] ..... C06B 31/28

[52] U.S. Cl. ..... 149/46; 149/108.2; 149/109.6; 102/334

[58] Field of Search ..... 149/46, 109.6, 149/108.2; 102/334

[56] References Cited

U.S. PATENT DOCUMENTS

| | | | |
|---|---|---|---|
| 2,603,607 | 7/1952 | Stevenson | 102/344 |
| 3,109,821 | 11/1963 | York et al. | 102/344 |
| 3,720,553 | 3/1973 | Henderson | 149/46 |
| 4,152,891 | 5/1979 | Garner | 149/41 |
| 4,898,098 | 2/1990 | Frey et al. | 102/344 |

*Primary Examiner*—Donald P. Walsh
*Assistant Examiner*—Anthony R. Chi
*Attorney, Agent, or Firm*—Schweitzer Cornman & Gross

[57] ABSTRACT

A smoke-generating combustion charge is disclosed having a nitrate-containing oxidizing agent combined with wetted carbon granules to cause polar binding of the oxidizing agent. Such a charge produces a non-toxic smoke, and is environment-compatible, even when the charge fails to ignite, or is combusted incompletely. The method of preparation for the smoke charge comprises the separate treatment of the oxidizing agent and the reducing agent, followed by common mixing and press-forming to produce pellets.

17 Claims, 1 Drawing Sheet

SMOKE CHARGE AND METHOD FOR ITS PREPARATION

This invention relates to a smoke charge consisting of an ignition layer and a pyrotechnical combustion charge which comprises an inorganic oxidizing agent and a carbon-containing reducing agent.

BACKGROUND OF THE INVENTION

U.S. Pat. No. 3,542,610 discloses a pyrotechnical smoke charge which consists of an inorganic oxidizing agent, a fuel and a smoke-producing oil. The components of the combustion charge are selected in such a way that the combustion temperature suffices to evaporate the oil, but not to burn it. This process produces sulfides and mercaptans which constitute environmental hazards and which are toxic to living organisms.

A further smoke charge is known from Swiss Patent No. A5 - 638 168. This charge consists of zinc oxide, ammonium perchlorate, of polychloroisoprene as a chlorine donator, a softening agent and ammonium chloride for buffering. This smoke charge produces a chemically neutral smoke in the pH-range of 5–7, but releases harmful heavy metals and chlorides.

It is thus an object of the invention to provide a smoke charge the pyrotechnical combustion charge of which produces a dense, well-camouflaging smoke that releases no toxic substances and is in principle environment-compatible.

This object is achieved by use of a hygroscopic oxidizing agent, a reducing agent consisting of porous carbon granules, and a polar solvent to bind the oxidizing agent to the carbon granules.

The resulting combustion charge produces the smoldering combustion desired in smoke charges. A substantial advantage of the invention is that non-combusted or partially combusted smoke charge portions dissolve in atmospheric humidity or in rain, with little distinction from common chemical fertilizers. deleterious environmental effects have been determined. No The method according to the invention for preparing the smoke charge consists in a first method step of wetting active carbon with water in a mechanical mixer. In a second step ammonium nitrate is ground in a ball mill. In a further step the wetted active carbon is admixed to the ammonium nitrate in the ball mill, where the substances are mixed with one another to form the combustion charge.

Water has been found to give outstanding service as the polar solvent. Suitable oxidizing agents have been found to be nitrate salts and, in particular, ammonium nitrate. A range of particle sizes can be utilized in the invention. It is expedient to press-form the combustion charge mixture on a conventional press.

The present invention is suitable for the preparation of smoke charges for special marking purposes or charges for smoke-absorbing infrared radiation when color pigments and/or binders and/or metal particles are included in the charge mixture. The charge of the present invention may be used for smoke-producing ammunition as used on vehicles such as tanks, etc.

BRIEF DESCRIPTION OF THE DRAWINGS

A fuller understanding of the present invention can be obtained by reference to the following detailed description thereof, in conjunction with the annexed drawings, wherein.

DETAILED DESCRIPTION OF THE INVENTION

Figure 1:
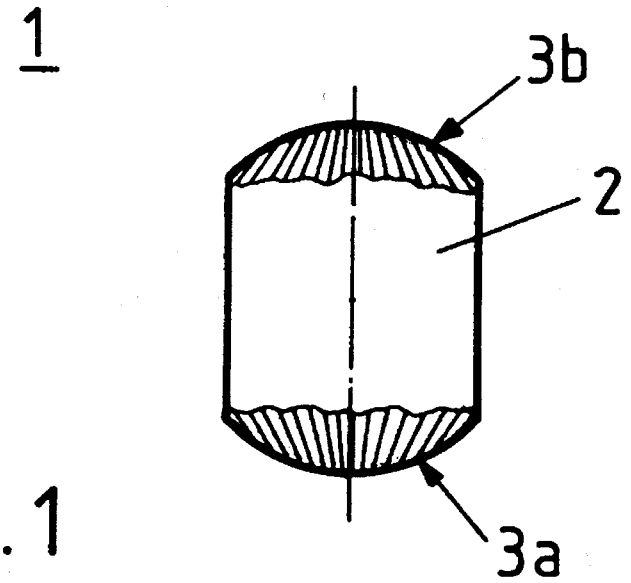
FIG. 1 is a diagrammatic representation of a smoke charge, consisting of a cylindrical combustion charge coated with an ignition charge.
Figure 2:
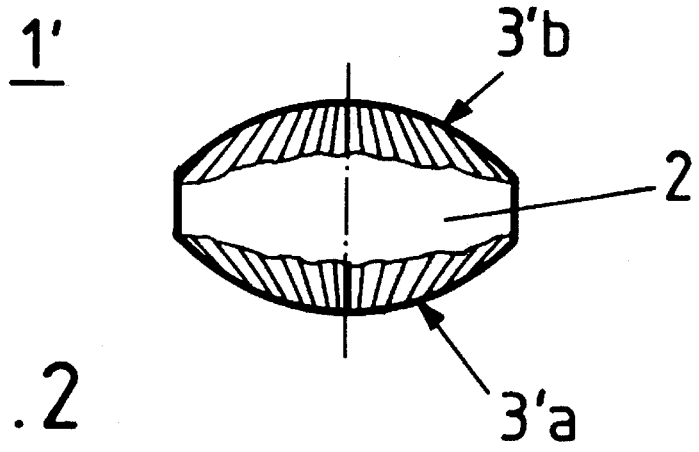
FIG. 2 is a similarly coated, pill-shaped combustion charge, both in accordance with the present invention.

In FIG. 1, numeral 1 designates a cylindrical smoke charge formed in accordance with the present invention which is provided with an ignition charge 3*a* and 3*b*, respectively, on both of its end faces. This type of briquette charge, also known as a pellet, has a mass of about 3 g with a diameter of 10 mm and a height of 12 min. The end faces are crowned. Similarly shaped, according to FIG. 2, is a smoke charge briquette 1'. The latter has a diameter of about 13 mm and a height of about 10 mm.

Both variants are coated with per se known ignition charges in a press at pressures between 40 and $100\times10^3$ N/cm$^2$. Such ignition layers are known, e.g., from the European Patent No. A1 -0 322 951. In a third variant, not shown, the combustion charge is not given a coating. It is sufficient to ignite it from the outside, using known pyrotechnical auxiliaries.

The charge of the present invention is formed of a mixture of a carbon-reducing agent, preferably active carbon granules, combined with a hydroscopic, inorganic oxidizing agent, preferably a nitrate. The oxidizing agent is bound to the reducing agent, preferably by a polar solvent. The resulting mass can then be press-formed in a known manner to form the briquette, which can be coated with an ignition charge. Color pigments, binders and metal particles can be added to the charge mixture, as known in the art, to color the smoke produced.

A range of components may be utilized in the invention, with weight ratios of between 80:20 and 95:5 of oxidizing agent to reducing agent being preferred. The reducing agent may be combined with the solvent prior to being combined with the oxidizing agent. Best results were achieved with a mixture of 90 wt-% ammonium nitrate and 10 wt-% active carbon. When water, a preferred solvent, is utilized, a preferred range is from 5 to 15 weight percent of the reducing agent/solvent mixture. The mean particle sizes for the reducing agent may be between 30 and 50 μm, which the mean particle size for the oxidizing agent is between 800 and 1200 μm. When using dried ammonium nitrate, a mean particle size of 1000 μm is indicated, and with the finely granulated active carbon, a mean particle size of 40 μm.

For preparation of 1 kg of combustion mass, 100 g of commercially available, pure, finely granulated active carbon are disposed in a tumbling mixer, with 75% of the particles having a particle size of 40 μm. Mixing continuously, 10 ml of distilled water are admixed in portions.

At the same time, 900 g of dried commercially available ammonium nitrate are carefully ground in a ball mill, impacts and excessive friction being avoided, until a particle size of 1000 μm has been achieved. During this stage, the relative humidity of the air should, for safety reasons, be maintained in the range of 40 to 70%.

Subsequently, the prepared active carbon is added to the ground ammonium nitrate in the ball mill and both components are mixed.

It is possible to store the combustion mass before the press-forming step. No changes could be found after a period of two weeks storage in a closed container at constant room temperature.

In case of a possible admixture of additives for color marking or for the attainment of other effects in addition to the generation of smoke, it is obvious that care must be taken to prevent impermissible loads of noxious materials.

The disclosure of Swiss Patent Application Serial No. 02 959/93-8 of Oct. 1, 1993, of which priority is claimed, is incorporated herein by reference.

We claim:

1. A smoke charge comprising an ignition layer and a pyrotechnical combustion charge comprising a hydroscopic, inorganic oxidizing agent, a carbon-containing reducing agent, and a polar solvent to bind the oxidizing agent to the reducing agent, the combustion charge being in the form of a briquette having a diameter of about 13 mm and a height of about 10 mm, said ignition layer coating at least one surface of said briquette.

2. A smoke charge comprising an ignition layer and a pyrotechnical combustion charge comprising a hydroscopic, inorganic oxidizing agent, a carbon-containing reducing agent, and a polar solvent to bind the oxidizing agent to the reducing agent, wherein the proportion of oxidizing agent to the reducing agent is 80 to 95 weight percent oxidizing agent to 20 to 5 weight percent reducing agent.

3. The smoke charge as claimed in claim 2 or 1, wherein said reducing agent is porous carbon granules.

4. The smoke charge as claimed in claim 2 or 1, wherein the polar solvent is water.

5. The smoke charge as claimed in claim 3, wherein the porous carbon granules are of pulverized active carbon.

6. The smoke charge as claimed in claim 2 or 1, wherein the oxidizing agent is a nitrate salt.

7. The smoke charge as claimed in claim 6, wherein the nitrate salt is ammonium nitrate.

8. The smoke charge as claimed in claim 1, wherein the proportion of the oxidizing agent to the reducing agent is 80 to 95 weight percent oxidizing agent to 20 to 5 weight percent reducing agent.

9. The smoke charge as claimed in claim 2 or 1, wherein the reducing agent comprises 5 to 15 weight percent water.

10. The smoke charge as claimed in claim 6, wherein the oxidizing agent has a mean particle size of 800 to 1200 μm, and the reducing agent has a mean particle size of 30 to 50 μm.

11. A method for preparing a smoke charge having a pyrotechnical combustion charge comprising a hydroscopic inorganic oxidizing agent, a carbon-containing reducing agent, and a polar solvent, comprising the steps of wetting the reducing agent with water; grinding the inorganic oxidizing agent in a ball mill; and admixing the wetted reducing agent to the inorganic oxidizing agent in the ball bill in a ratio of 80 to 95 weight percent inorganic oxidizing agent to 20 to 5 weight percent reducing agent to form the combustion charge.

12. The method for preparing a smoke charge as claimed in claim 11, comprising the further step of filling the carbon-ammonium nitrate mixture into a press and forming the combustion charge therein.

13. The method for preparing a smoke charge as claimed in claim 11, further comprising the step of admixing at least one of a color pigment, a binder or metal particles to the carbon-ammonium nitrate mixture in the ball mill.

14. The method for preparing a smoke charge as claimed in claim 11 or 13, comprising the further step of placing a first partial quantity of an ignition charge into a press form; disposing the combustion-charge mixture upon the first partial quantity of the ignition charge; placing a second partial quantity of the ignition charge into the press form; and pressing the press-form contents to yield a briquette.

15. A method for preparing a smoke charge having a pyrotechnical combustion charge comprising a hydroscopic inorganic oxidizing agent, a carbon-containing reducing agent and a polar solvent, comprising the steps of wetting the reducing agent with water; grinding the oxidizing agent in a ball mill; admixing the wetted reducing agent to the oxidizing agent in the ball mill to form a combustion charge; placing a first partial quantity of an ignition charge into a press-form; disposing the combustion charge mixture upon the first partial quantity of the ignition charge; placing a second partial quantity of the ignition charge onto the press-form; and pressing the press-form contents to yield a briquette.

16. The method for preparing a smoke charge as claimed in claim 15, further comprising the step of admixing at least one of a color pigment, a binder or metal particles to the oxidizing agent-reducing agent mixture in the ball mill.

17. The smoke charge as claimed in claim 7, wherein the reducing agent has a mean particle size of 30 to 50 μm.

* * * * *